US010658736B2

(12) United States Patent
Dabrowski et al.

(10) Patent No.: US 10,658,736 B2
(45) Date of Patent: May 19, 2020

(54) DOMINANT H-FIELD MULTIBAND LOOP ANTENNA INCLUDING PASSIVE MIXER

(71) Applicant: The Boeing Company, Chicago, IL (US)

(72) Inventors: Ted Ronald Dabrowski, Huntsville, AL (US); Larry Leon Savage, Huntsville, AL (US); Robert Alan Smith, Hampton, AL (US)

(73) Assignee: The Boeing Company, Chicago, IL (US)

( * ) Notice: Subject to any disclaimer, the term of this patent is extended or adjusted under 35 U.S.C. 154(b) by 610 days.

(21) Appl. No.: 15/344,525

(22) Filed: Nov. 6, 2016

(65) Prior Publication Data

US 2018/0131079 A1 May 10, 2018

(51) Int. Cl.

| | |
|---|---|
| ***H01Q 1/24*** | (2006.01) |
| ***H01Q 1/22*** | (2006.01) |
| ***H01Q 5/50*** | (2015.01) |
| ***H01Q 7/00*** | (2006.01) |
| ***H01Q 1/38*** | (2006.01) |
| ***H01Q 1/28*** | (2006.01) |
| ***H01Q 23/00*** | (2006.01) |

(52) U.S. Cl.
CPC ..... *H01Q 1/247* (2013.01); *H01Q 1/28* (2013.01); *H01Q 1/38* (2013.01); *H01Q 7/00* (2013.01); *H01Q 23/00* (2013.01)

(58) Field of Classification Search
CPC ..... H01Q 1/247; H01Q 23/00; H01Q 1/38; H01Q 1/28; H01Q 7/00
See application file for complete search history.

(56) References Cited

U.S. PATENT DOCUMENTS

| | | | | |
|---|---|---|---|---|
| 6,950,076 | B2 | 9/2005 | Holly | |
| 8,299,994 | B2 | 10/2012 | Wang et al. | |
| 2008/0074265 | A1* | 3/2008 | Schoen | G08B 13/1427 340/572.1 |
| 2010/0117454 | A1* | 5/2010 | Cook | H01Q 7/00 307/104 |
| 2014/0371559 | A1* | 12/2014 | Etzkorn | A61B 5/682 600/347 |
| 2016/0218434 | A1* | 7/2016 | Akyildiz | H01Q 1/38 |

* cited by examiner

*Primary Examiner* — Hai V Tran
*Assistant Examiner* — Michael M Bouizza
(74) *Attorney, Agent, or Firm* — Yee & Associates, P.C.

(57) ABSTRACT

An antenna. The antenna includes a plurality of loop antennas sharing a common gap. The antenna also includes a nonlinear mixing component connected to the gap and configured to collect energy from at least one of the plurality of loop antennas.

20 Claims, 6 Drawing Sheets

DOMINANT H-FIELD MULTIBAND LOOP ANTENNA INCLUDING PASSIVE MIXER

BACKGROUND INFORMATION

1. Field

The present disclosure relates to methods and devices for dominant H-field multiband loop antennas that include passive mixers for creating unique radio frequency signals in response to a particular input.

2. Background

Antennas are divided into two major subdivisions, E-field and H-field antennas. An E-field antenna utilizes voltages as a means to interact with electromagnetic waves. H-field antennas utilize current distributions that arise from an incident electromagnetic wave. H-field antennas are typically inductive.

SUMMARY

The illustrative embodiments provide for an antenna. The antenna includes a plurality of loop antennas sharing a common gap. The antenna also includes a nonlinear mixing component connected to the gap and configured to collect energy from at least one of the plurality of loop antennas.

The illustrative embodiments provide for an antenna. The antenna includes a substrate. The antenna also includes a first loop antenna attached to the substrate, the first loop antenna having a first perimeter. The antenna also includes a second loop antenna attached to the substrate, the second loop antenna having a second perimeter, the second perimeter connected to the first perimeter, the second loop antenna substantially inside the first loop antenna. The antenna also includes a third loop antenna attached to the substrate, the third loop antenna having a third perimeter, the third perimeter connected to the first perimeter at about a junction where the first perimeter is connected to the second perimeter, the third loop antenna substantially outside the first loop antenna. The antenna also includes a mixing component attached to the substrate, at the junction.

The illustrative embodiments also provide for a detection system. The detection system includes a plurality of objects, each of the plurality of objects comprising a corresponding antenna. Each corresponding antenna includes a corresponding plurality of loop antennas sharing a corresponding common gap; and a corresponding nonlinear mixing component connected to the corresponding gap and configured to collect energy from at least one of the corresponding plurality of loop antennas. The detection system also includes a transmitter transmitting a signal, wherein when the signal is received at a particular set of the corresponding plurality of loop antennas, a unique mixed product signal is generated based on a specific design of the particular set of the corresponding plurality of loop antennas. The detection system also includes a receiver configured to receive the unique reply signal. The detection system also includes a computer configured to identify the unique reply signal as belonging to a specific one of the plurality of objects. The detection system also includes an alert system connected to the computer and configured to alert a user when the unique reply signal has been received.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

Figure 1:
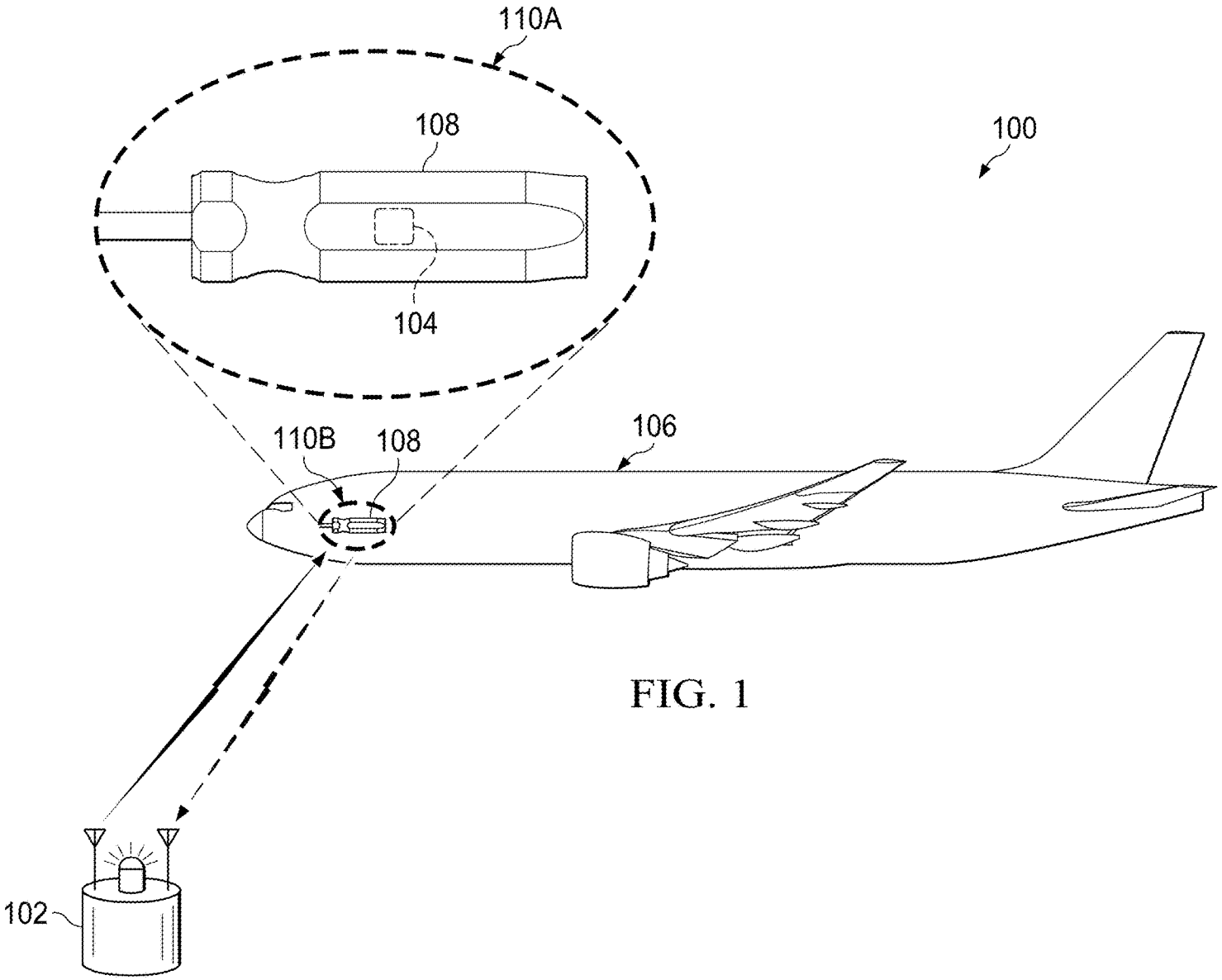
FIG. 1 illustrates a system for detecting foreign objects inside a larger object, in accordance with an illustrative embodiment.

The illustrative embodiments recognize and take into account that, as indicated above, antennas are divided into two major subdivisions, E-field and H-field antennas. An E-field antenna utilizes voltages as a means to interact with electromagnetic waves. A stronger E-field incident upon an antenna will induce a larger voltage difference across the antenna's terminals. E-field antennas are typically capacitive and will change their electrical properties when placed in proximity to metallic structures.

H-field antennas utilize current distributions that arise from an incident electromagnetic wave. H-field antennas are typically inductive and are more resilient to altering their electrical properties in proximity to metallic structures.

The illustrative embodiments primarily use the H-field antenna type. E-field antennas would have to be designed differently for each material, possibly each object to which the antenna was attached, to compensate for the coupling caused by the metallic structure. Alternatively, E-field antennas would have to be backed by a controlled metal prior to application to the object or tool in question. H-field antennas are more resilient in this regard, and thus are easier to sue when placed in or on metallic objects.

In a specific application of the antennas of the illustrative embodiments, the antennas described herein may be mounted on tools made of different materials. Because the tool has an antenna mounted in or on the tool, the tool may be located if dropped or lost inside a larger object. Because H-field antennas are primarily used herein, the illustrative embodiments are therefore resistant to being placed on or in metallic tools.

In a particular application, one of the significant issues that has potential to result in unwanted consequences is foreign object debris (FOD) left in aircraft during manufacturing or maintenance. Such foreign objects could include tools unintentionally left in aircraft after manufacturing or maintenance. The focus of the system outlined for this particular example is on the management of mechanical tools that potentially become foreign object debris if misplaced.

The foreign object debris system outlined here includes two major sub-systems, the transmitter/detector and the passive tag. The transmitter/detector is used by an operator and passive tags are adhered to tools used in the airport, manufacturing, or maintenance environment.

When the foreign object debris system is activated, any antenna that is illuminated by the transmitter with sufficient power will emit a signal that is received by the detector and notifies the user of an object's presence. This signal may be unique to the antenna which is attached to a given tool, and thus identification of the tool may be possible prior to retrieval.

Stated differently, an application for the illustrative embodiments contemplates a plurality of multiband antennas, a passive mixing component, and an applique style substrate (rigid or flexible) to comprise a radio-frequency identification (RFID) tag. The unique attributes of these antenna elements may create an RFID tag which is less susceptible to changes in antenna resonance due to material proximity. Combining these attributes with a passive nonlinear mixing component produces an RFID tag that receives two or more incident frequencies and radiates a mixed product frequency without the need of a DC power source.

Attention is now turned to the antennas of the illustrative embodiments themselves. When designing a traditional antenna there is typically one dominant resonant frequency that has some associated bandwidth. Using the antenna at this designed dimension allows for maximum power to be captured by the aperture of the antenna. For loop antennas the overall arc length C of the loop determines the dominant resonant frequency of the structure. The illustrative embodiments recognize and take into account that, by connecting multiple loop antennas in a common structure, a single element with multiple dominant resonances is created.

The antennas of the illustrative embodiments are placed such that they share a common gap used as a power measurement point. By placing a nonlinear mixing component at this location, maximum power is delivered by energy collected from loops $C_2$ and $C_3$ to this component. If the loop $C_1$ is designed to resonate at a mixed frequency of $C_2$ and $C_3$ then the power provided will serve as an exciter for $C_1$. Thus, the illustrative embodiments provide for a dominant H-field multiband loop antenna including a passive mixer.

There is nothing limiting the design of the antennas to circular loops. The antennas of the illustrative embodiments could be ellipsoids, rectangular, and linear dipoles. It is also possible to design a unit that has different combinations of antenna types to meet the needs of the environment they will be placed in.

The nonlinear mixing component may be a diode. The nonlinear mixing component may also be other nonlinear devices such as carbon nanotubes, graphene, or doped materials.

The illustrative embodiments provide several benefits over known antennas. For example, the illustrative embodiments provide for a reduction in size of the antenna over current in-house versions of passive tag structures. The illustrative embodiments provide for generating a mixed signal without the need for supplied power to the mixing element. The illustrative embodiments provide for an H-field antenna design that reduces resonance shifting due to proximity with metal surfaces compared to E-field antennas. This effect allows for a single antenna design to function on a wider range of materials than an E-field counterpart. Thus, the illustrative embodiments may be described as a dominant h-field multiband loop antenna including a passive mixer.

The antennas of the illustrative embodiments are easy to manufacture on flex materials allowing for mounting on conformal surfaces. The antennas of the illustrative embodiments may be designed to produce a unique radio frequency return signature based on two or more transmitted signals. By using many transmit signals, multiple mixing results could be used as a specific item identification more similar to a traditional radio frequency identification tag (RFID tag).

The antennas of the illustrative embodiments also reduce the coupling between the antenna and its surrounding materials. The antennas of the illustrative embodiments also remove the requirement of diverting or supplying external power to the mixing component.

Other types of antennas, other than those described herein, could be used in a variety of different systems, including a foreign object detection system. However, such other antennas suffer from known disadvantages.

For example, one approach is to signal mixing & antenna/material isolation is to develop a separate antenna that collects energy to be provided to an active mixer (potentially at a different frequency). However, this approach increases the overall size and complexity of the antenna. For many applications it is desirable that the antenna remain as small as possible.

Another approach is to divert some of the collected energy from the main antennas to an active mixer. However, this approach will lower the amount of energy going into the mixer.

Still another approach is to separate the antenna from the material by including an acceptable dielectric of appreciable thickness between the antenna and material. However, this approach adds to the overall height of the antenna, which effectively increases its overall size and possibly its complexity. Again, for many applications it is desirable that the antenna remain as small as possible.

In contrast, the antennas of the illustrative embodiments described herein require no additional antenna and/or power network to activate a mixing component while also providing reduced coupling between antenna and material. Thus, the antennas of the illustrative embodiments represent a significant improvement over existing antenna technology.

FIG. 1 illustrates a system for detecting foreign objects inside a larger object, in accordance with an illustrative embodiment. FIG. 1 illustrates a specific illustrative example of an application for the antennas described with respect to FIG. 3 through FIG. 8.

System 100 may be characterized as a foreign object detection system. System 100 includes two major subsystems, transmitter/detector 102 and antenna 104, which serves as a passive tag. Transmitter/detector 102 is used by an operator when it is desirable to check for or search for foreign objects inside object 106. Antennas, such as antenna 104, are adhered to tools, such as tool 108, used with respect to object 106.

Note that section 110A is an expanded view of section 110B. As can be seen, antenna 104 is much smaller.

When system 100 is activated, any tag (such as antenna 104) that is illuminated by transmitter/detector 102 with sufficient power will emit a signal that is received by the detector of transmitter/detector 102 and will effectively notify the user of the presence of object 106. The focus of the illustrative embodiments is on antenna 104, with transmitter/detector 102 being available as an off-the-shelf product. Transmitter/detector 102 may be controlled by a computer, such as data processing system 900 of FIG. 9, and may be used in a computer implemented method for detecting foreign objects or pinging any of the antennas described herein.

Figure 2:
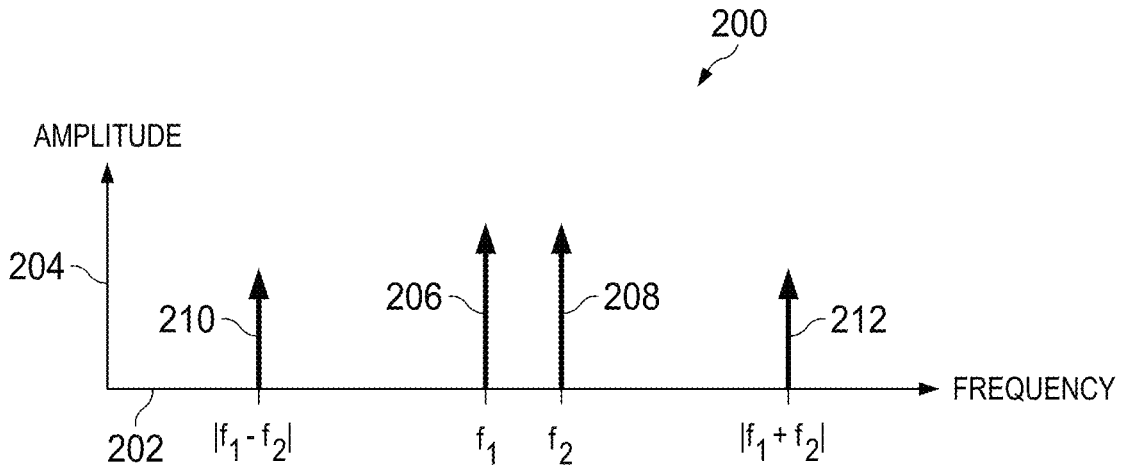
FIG. 2 illustrates a graph of frequency versus amplitude and also illustrates frequency mixing, in accordance with an illustrative embodiment.

FIG. 2 illustrates graph 200 of frequency 202 versus amplitude 204 and also illustrates frequency mixing, in accordance with an illustrative embodiment. The illustrative embodiments described with respect to FIG. 3 through FIG. 8 use a principle known as frequency mixing. Graph 200 of FIG. 2 is used to illustrate this principle. FIG. 2 represents a two-frequency case.

Frequency mixing occurs when two or more signals of different frequencies, such as $f_1$ 206 and $f_2$ 208, are passed through a nonlinear device, such as a diode or some other device as described further below with respect to FIG. 3 through FIG. 8. The results of mixing are sum and difference products that are located at the sum and difference of the carrier frequencies. The sum is represented by $|f_1-f_2|$ 210 and $|f_1+f_2|$ 212. Typically, the difference product is considered in signal processing due to the reduced complexity of equipment used to discern the signal.

Figure 3:
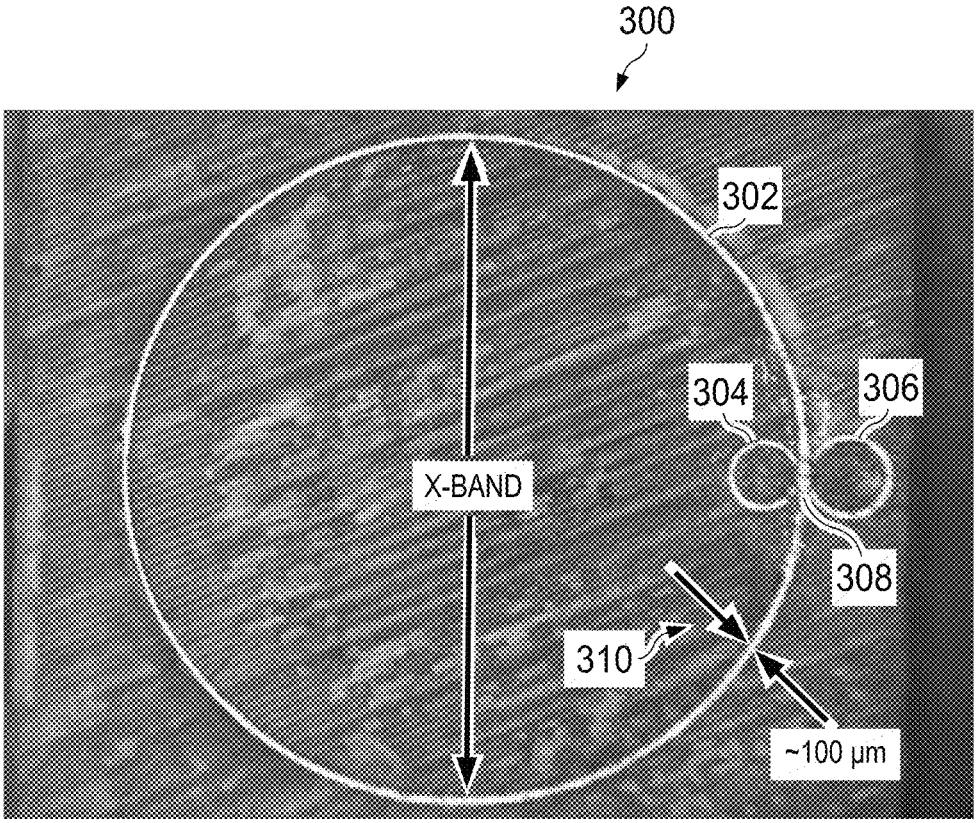
FIG. 3 illustrates a three-loop antenna, in accordance with an illustrative embodiment.

FIG. 3 illustrates a three-loop antenna, in accordance with an illustrative embodiment. Antenna 300 may be an example of antenna 104 of FIG. 1. Although antenna 300 is referred to in the singular, antenna 300 may be considered a combination of three antennas, as described below. Antenna 300 is not limited to just three loops, however. Potentially any number of loops could be used for antenna 300.

When designing a traditional antenna there is typically one dominant resonant frequency that has some associated bandwidth. Using the antenna at this designed dimension allows for maximum power to be captured by the aperture of the antenna.

For loop antennas, such as antenna 300, the overall arc length C 302 of the loop determines the dominant resonant frequency of the structure of antenna 300. By connecting multiple loop antennas in a common structure, a single element with multiple dominant resonances is created.

The antennas of the illustrative embodiments are placed such that they share a common gap, including mixing component 308, used as a power measurement point. Mixing component 308 may be a diode or, as described above, some other suitable material or device such as carbon nanotubes, graphene, or doped materials. By placing this nonlinear mixing component 308 at this junction or common point, maximum power is delivered by energy collected from loop $C_2$ 306 and loop $C_3$ 304 to mixing component 308. If loop $C_1$ 302 is designed to resonate at a mixed frequency of loop $C_2$ 306 and loop $C_3$ 304 then the power provided will serve as an exciter for loop $C_1$ 302. Frequency mixing is performed at mixing component 308, as described with respect to FIG. 2.

There is nothing limiting the design of the antennas to circular loops. Any of the above loops could be ellipsoids, rectangular, or linear dipoles, for example. It is also possible to design a unit that has a combination of these antenna types to meet the needs of the environment in which they will be placed.

Attention is now turned to principles of using a diode as a nonlinear mixing component for mixing component 308. A diode is a nonlinear device that can be used to create an unbalanced mixer. The current I through an ideal diode is given by the Shockley equation as:

$$I = I_S[e^{\frac{qv_D}{nkT}} - 1]$$

where k is Boltzmann's constant, q is the magnitude of the electrical charge of an electron, T is the temperature, n is the emission coefficient, $I_S$ is the saturation current, and $v_D$ is the diode voltage. By expanding and using a small argument approximation for two input voltages $v_1+v_2$ that is applied to the diode, the output voltage can be written as:

$$v_0=(v_1+v_2)+\tfrac{1}{2}(v_1+v_2)^2.$$

The first term is the sum of the original voltages and the square term can be rewritten as:

$$(v_1+v_2)^2=v_1^2+2v_1v_2+v_2^2,$$

where $v_1^2$ and $v_2^2$ are higher power sum terms, which are assumed to be negligible for small signals. To demonstrate signal mixing the two input voltages are defined as sinusoids with different frequencies as:

$$v_1=\sin(at)$$

$$v_2=\sin(bt)$$

and the output voltage is re-written as:

$$v_0=(\sin(at)+\sin(bt))+\tfrac{1}{2}(\sin(at)^2+2\sin(at)\sin(bt)+\sin(bt)^2).$$

Ignoring the higher order terms except for the product term and using the product to sum identity, the output voltage can be expressed as:

$$v_0=\cos((a-b)t)-\cos(a+b)t)$$

showing the mixed frequencies created by the mixer.

Returning to FIG. 3, antenna 300 may use the resonant dimensions of two W-band frequencies (loop $C_2$ 306 and loop $C_3$ 304) and a single resonant dimension of an X-band frequency (loop $C_1$ 302). Note, however, that other bands could be used by changing the parameters of these loops. For example, the lower band does not need to be X-band. A Ku, K, or Ka-band resonator could be used for size reduction. There is also no permanent requirement for use of the W-band as the upper band; any band that can provide the desired lower band mixing products is possible. This configuration is shown in FIG. 4.

Antenna 300 may be made very small. For example, the thickness of loop 300 may be less than 100 micrometers, as shown by arrows 310. Thus, antenna 300 is suitable for implantation in hand-held tools including hammers, screw drivers, wrenches, drills, saws, channel locks, pliers, or any other kind of hand-held tool. Antenna 300 is also suitable for implantation in any object which is substantially larger than antenna 300. Thus, antenna 300 could be used in place of RFID tags in tracking inventory on an aircraft, product management, or any other suitable purpose for which RFID tags would also be useful. Note, again, that antenna 300 is not an RFID tag. Rather, because the return signal from antenna 300 when interrogated by a transmitter/receiver may be made unique, and thus antenna 300 could serve as a substitute for an RFID tag.

Figure 4:
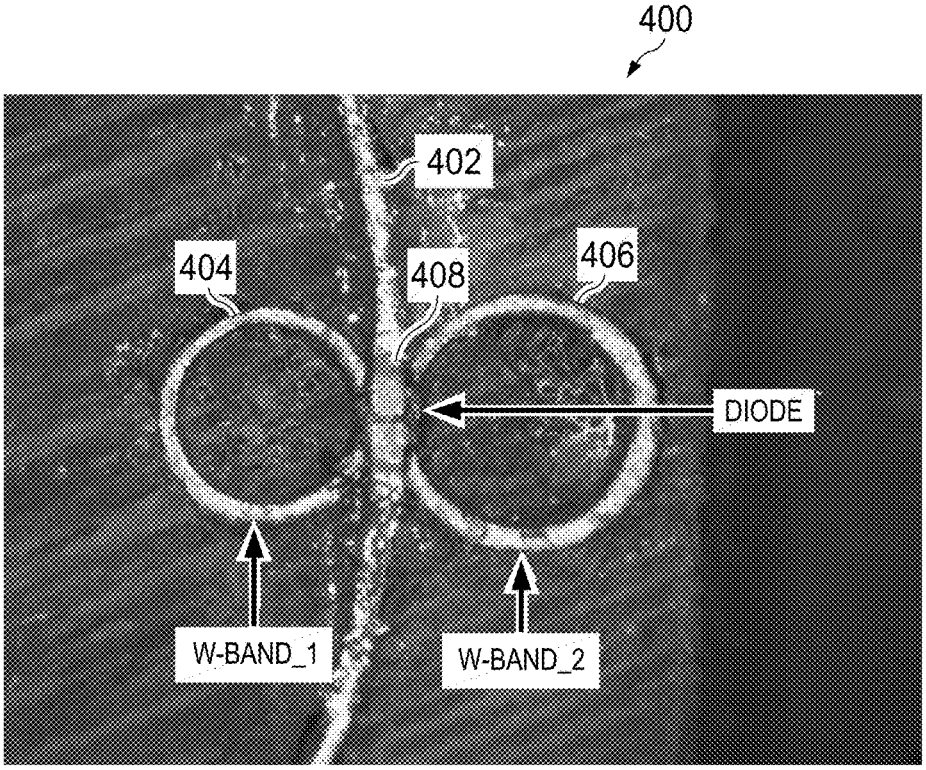
FIG. 4 is a close up of the junction and two smaller loops of the three-loop antenna of FIG. 3, in accordance with an illustrative embodiment.

FIG. 4 is a close up of the junction and two smaller loops of the three-loop antenna of FIG. 3, in accordance with an illustrative embodiment. Antenna 400 is a variation of antenna 104 of FIG. 1 and antenna 300 of FIG. 3.

Antenna 400 includes loop $C_1$ 402, loop $C_2$ 404, loop $C_3$ 406, and diode 408. Diode 408 serves as a nonlinear mixing component. In this illustrative example, loop $C_2$ 404 and loop $C_3$ 406 are two, different W-band loops.

Figure 5:
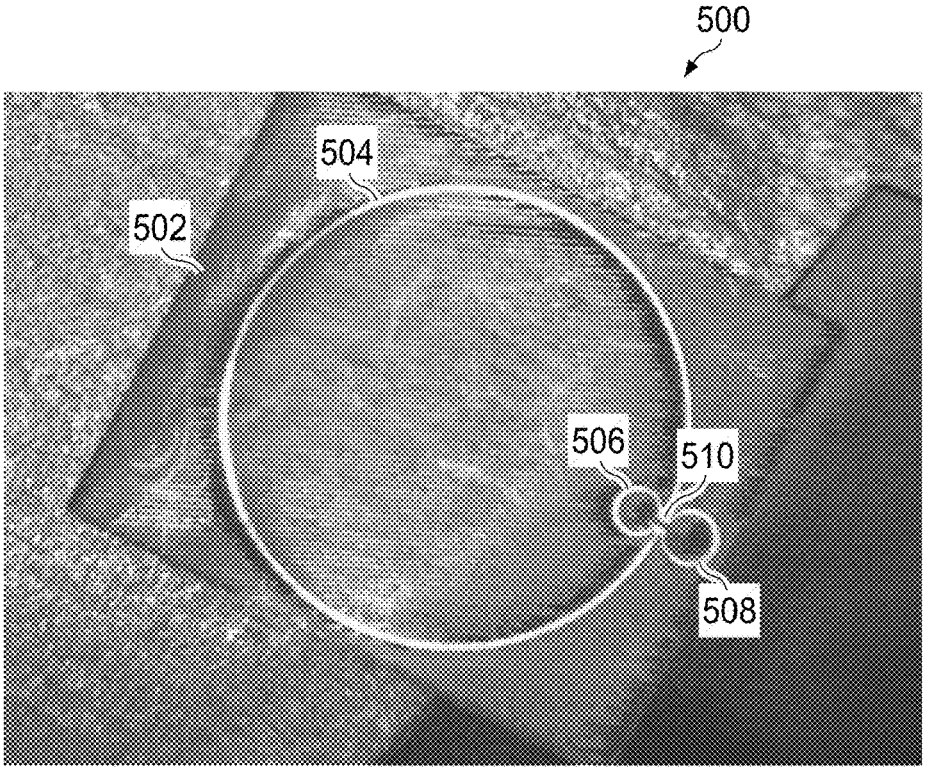
FIG. 5 is an illustration of a three-loop antenna on a flexible substrate, in accordance with an illustrative embodiment.

FIG. 5 is an illustration of a three-loop antenna on a flexible substrate, in accordance with an illustrative embodiment. Antenna 500 may be another variation of antenna 104 of FIG. 1, antenna 300 of FIG. 3, and antenna 400 of FIG. 4.

The illustrative embodiments may be formed on rigid substrate for implantation within tools. However, the illustrative embodiments may also be manufactured on hand-flexible surfaces, such as hand-flexible surface 502, so that antenna 500 may be mounted on an object instead of inside the object.

Otherwise, antenna 500 is designed in a similar manner as that described with respect to FIG. 1 through FIG. 4. Thus, for example, antenna 500 includes loop $C_1$ 504, loop $C_2$ 506, and loop $C_3$ 508, as well as mixing component 510. Antenna 500 operates as described above.

In an illustrative embodiment, hand-flexible surface 502 may be polyimide film (4,4'-oxydiphenylene-pyromellitimide) (which is marketed by DUPONT® as KAPTON®). Fabricating the proposed invention on hand-flexible surfaces (or other flexible materials) allows the antennas of the illustrative embodiments to be placed on curved surfaces. In this manner, the versatility of the illustrative embodiments may be extended.

As described above, the illustrative embodiments described with respect to FIG. 1 through FIG. 5 have several useful features. The illustrative embodiments provide for reduction in size over current in-house versions of passive tag structures. The illustrative embodiments provide for generating a mixed signal without the need for supplied power to the mixing element. The illustrative embodiments provide for H-field antenna design which reduces resonance shifting due to proximity with metal surfaces compared to E-field antennas. This allows feature for a single antenna design to function on a wider range of materials than an E-field counterpart.

The illustrative embodiments provide may be manufactured on flex materials, allowing for mounting on conformal surfaces. The illustrative embodiments provide for producing a unique radio frequency return signature based on two or more transmitted signals. By using many transmit signals, multiple mixing results could be used as a specific item identification similar to a traditional RFID tag.

Figure 6:
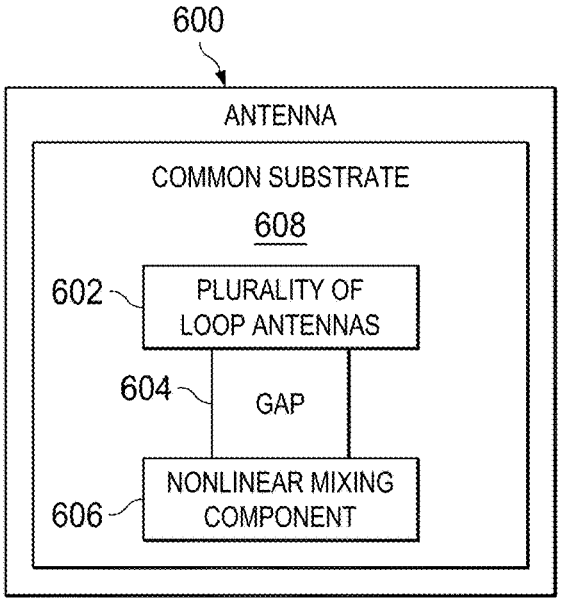
FIG. 6 is an illustration of a block diagram of an antenna, in accordance with an illustrative embodiment.

FIG. 6 is an illustration of a block diagram of an antenna, in accordance with an illustrative embodiment. Antenna 600 may be another variation of antenna 104 of FIG. 1, antenna 300 of FIG. 3, antenna 400 of FIG. 4, and antenna 500 of FIG. 5.

Antenna 600 includes plurality of loop antennas 602 sharing common gap 604. Antenna 600 also includes nonlinear mixing component 606 connected to the gap and configured to collect energy from at least one of plurality of loop antennas 602.

Antenna 600 may be varied. For example, in an illustrative embodiment, nonlinear mixing component 606 may be a diode. In another illustrative embodiment, nonlinear mixing component 606 is selected from the group consisting of carbon nanotubes, graphene, and a doped material.

In still another illustrative embodiment, exactly one of plurality of loop antennas 602 is configured to radiate at a mixed product frequency of input frequencies provided via other ones of plurality of loop antennas 602. In another illustrative embodiment, plurality of loop antennas 602 all are reactive near field (H-field) antennas.

In yet another illustrative embodiment, all of plurality of loop antennas 602 are connected to common substrate 608. In still another illustrative embodiment, common substrate 608 is hand flexible.

Figure 7:
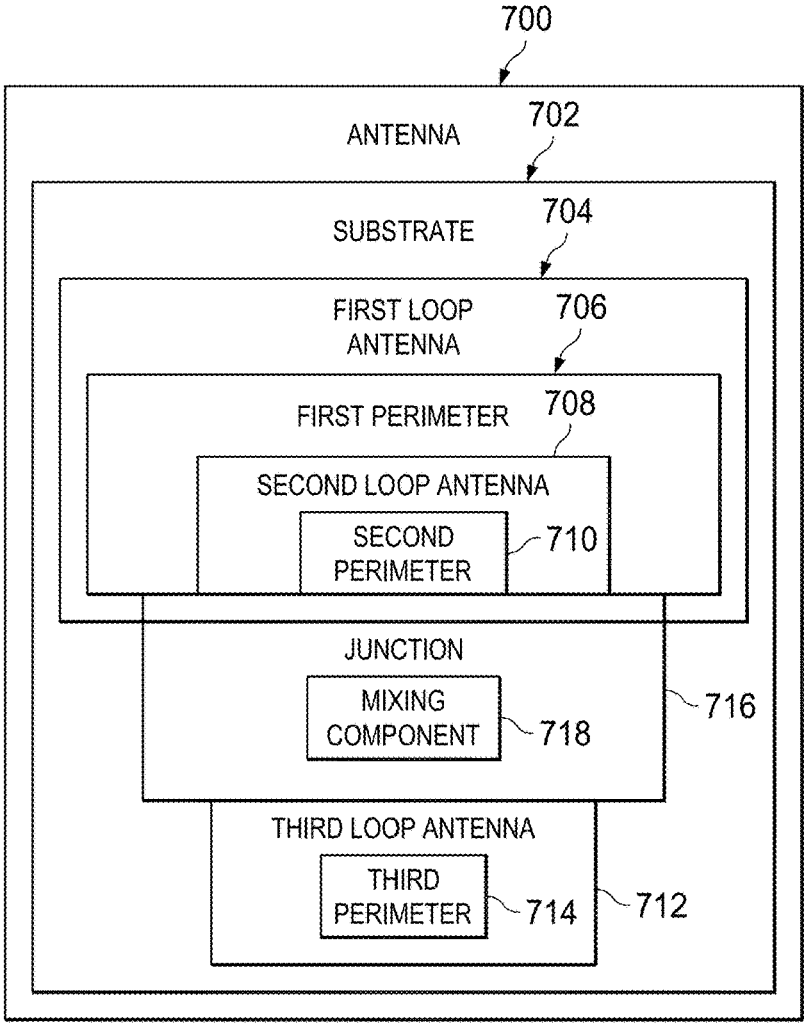
FIG. 7 is an illustration of a block diagram of another antenna, in accordance with an illustrative embodiment.

FIG. 7 is an illustration of a block diagram of another antenna, in accordance with an illustrative embodiment. Antenna 700 may be another variation of antenna 104 of FIG. 1, antenna 300 of FIG. 3, antenna 400 of FIG. 4, antenna 500 of FIG. 5, and antenna 600 of FIG. 6.

Antenna 700 includes substrate 702 and first loop antenna 704 attached to substrate 702. First loop antenna 704 has first perimeter 706.

Antenna 700 also includes second loop antenna 708 attached to substrate 702. Second loop antenna 708 has second perimeter 710. Second perimeter 710 is connected to first perimeter 706. Second loop antenna 708 is substantially inside first loop antenna 704.

Antenna 700 also includes third loop antenna 712 attached to substrate 702. Third loop antenna 712 has third perimeter 714. Third perimeter 714 is connected to first perimeter 706 at about junction 716 where first perimeter 706 is connected to second perimeter 710. Third loop antenna 712 is substantially outside first loop antenna 704.

Antenna 700 also includes mixing component 718 attached to substrate 702, at junction 716. Mixing component 718 may be a nonlinear mixing component. Mixing component 718 may also be a diode. Mixing component 718 may also be selected from the group consisting of carbon nanotubes, graphene, and a doped material.

Antenna 700 may be further varied. For example, in an illustrative embodiment, first loop antenna 704, second loop antenna 708, third loop antenna 712, and mixing component 718 together form a reactive near field (H-field) antenna.

In another illustrative embodiment, first loop antenna 704 is configured to resonate at a mixed product frequency of second loop antenna 708 and third loop antenna 712. In this case, mixing component 718 mixes a first frequency of the second loop antenna and a second frequency of the third loop antenna. Still further, mixing component 718 may be a radio frequency exciter for first loop antenna 704.

In yet another illustrative embodiment, second loop antenna 708 and third loop antenna 712 use W-band frequencies and first loop antenna 704 has a resonant dimension of an X-band frequency. In a different illustrative embodiment, second loop antenna 708 is smaller than third loop antenna 712. In this case, first loop antenna 704 is larger than both second loop antenna 708 and third loop antenna 712.

In still another illustrative embodiment, each of first loop antenna 704, second loop antenna 708, and third loop antenna 712 have corresponding shapes that are either the same as or different than other ones of the corresponding shapes. In this case, the corresponding shapes may be selected from the group consisting of circles, ellipsoids, rectangles, and linear dipoles.

Figure 8:
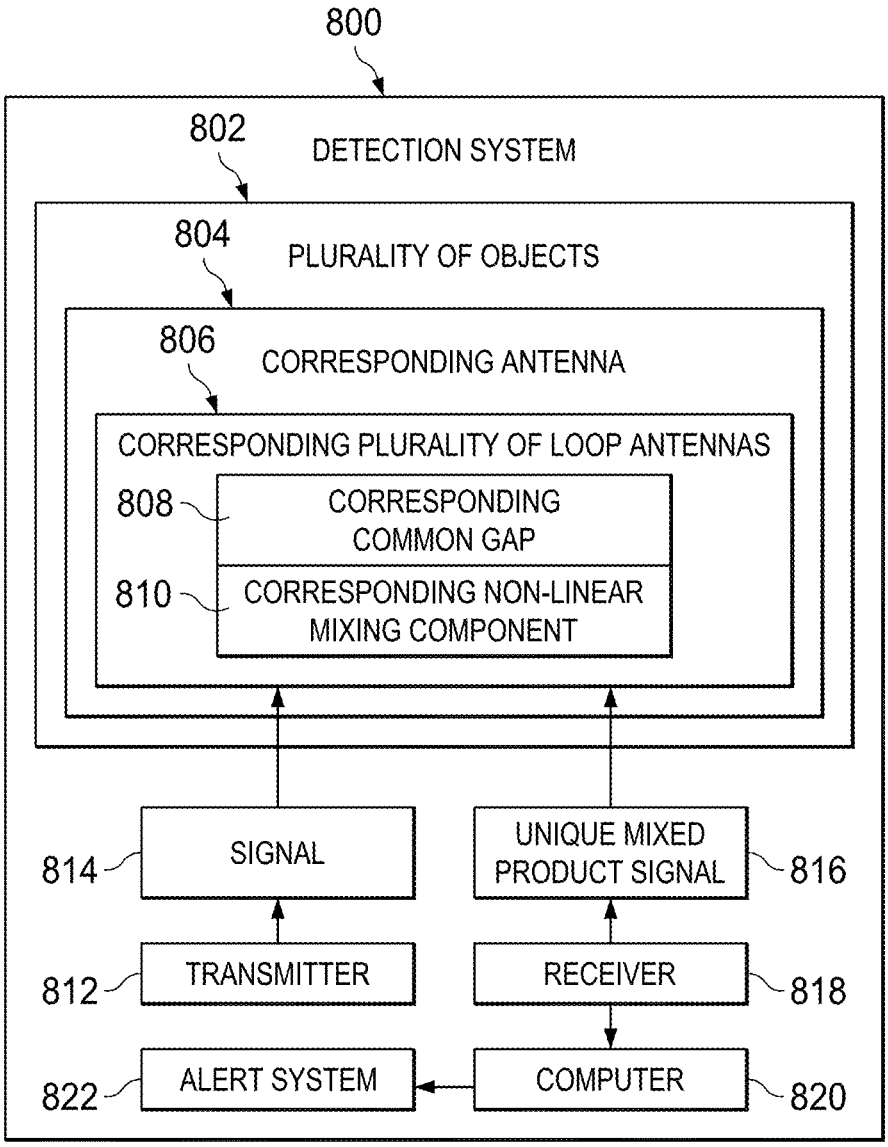
FIG. 8 is an illustration of a block diagram of a detection system, in accordance with an illustrative embodiment.

FIG. 8 is an illustration of a block diagram of a detection system, in accordance with an illustrative embodiment. Detection system 800 may use any of the antennas described herein, such as antenna 104 of FIG. 1, antenna 300 of FIG. 3, antenna 400 of FIG. 4, antenna 500 of FIG. 5, antenna 600 of FIG. 6, and antenna 700 of FIG. 7.

Detection system 800 includes plurality of objects 802. Each of plurality of objects 802 includes corresponding antenna 804. Each corresponding antenna 804 includes corresponding plurality of loop antennas 806 sharing corresponding common gap 808. Each corresponding antenna 804 also includes corresponding nonlinear mixing component 810 connected to common gap 808 and configured to collect energy from at least one of corresponding plurality of loop antennas 806.

Detection system 800 also includes transmitter 812 transmitting signal 814. When signal 814 is received at a particular set of corresponding plurality of loop antennas 806, unique mixed product signal 816 is generated based on a specific design of the particular set of corresponding plurality of loop antennas 806.

Detection system 800 also includes receiver 818 configured to receive unique mixed product signal 816. Detection system 800 also includes computer 820 configured to identify unique mixed product signal 816 as belonging to a specific one of plurality of objects 802. Computer 820 may be, for example, data processing system 900 of FIG. 9. Detection system 800 also includes alert system 822 connected to the computer and configured to alert a user when unique mixed product signal 816 has been received.

Detection system 800 may be varied. For example, each of the corresponding plurality of loop antennas may include corresponding substrate. Each of the corresponding plurality of loop antennas may also include a corresponding first loop antenna attached to the corresponding substrate. The corresponding first loop antenna has a first perimeter. Each of the corresponding plurality of loop antennas may also include a corresponding second loop antenna attached to the substrate. The corresponding second loop antenna has a second perimeter. The corresponding second perimeter connected to the first perimeter. The corresponding second loop antenna is substantially inside the corresponding first loop antenna.

Each of the corresponding plurality of loop antennas may also include a corresponding third loop antenna attached to the substrate. The corresponding third loop antenna has a third perimeter. The third perimeter is connected to the first perimeter at about the common gap where the first perimeter is connected to the second perimeter. The corresponding third loop antenna is substantially outside the corresponding first loop antenna. The corresponding mixing component is attached to the substrate, at the common gap.

Figure 9:
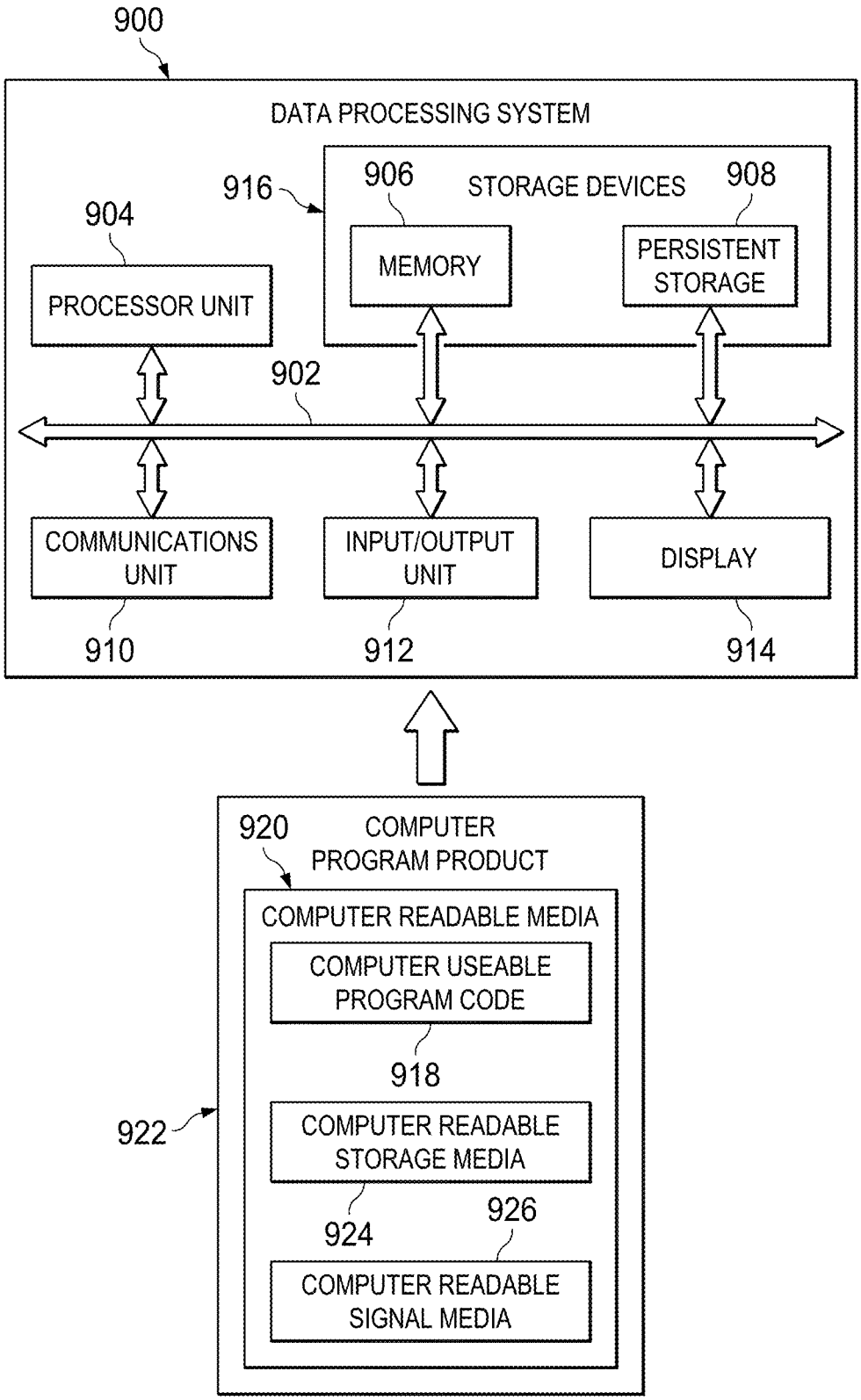
FIG. 9 is an illustration of a block diagram of a data processing system, in accordance with an illustrative embodiment.

Turning now to FIG. 9, an illustration of a data processing system is depicted in accordance with an illustrative embodiment. Data processing system 900 in FIG. 9 is an example of a data processing system that may be used to in conjunction with the illustrative embodiments, such as transmitter/receiver 102 of FIG. 1, or any other device or technique disclosed herein. In this illustrative example, data processing system 900 includes communications fabric 902, which provides communications between processor unit 904, memory 906, persistent storage 908, communications unit 910, input/output (I/O) unit 912, and display 914.

Processor unit 904 serves to execute instructions for software that may be loaded into memory 906. This software may be an associative memory, content addressable memory, or software for implementing the processes described elsewhere herein. Thus, for example, software loaded into memory 906 may be software for implementing the operations described above with respect to FIG. 6 through FIG. 8. Processor unit 904 may be a number of processors, a multi-processor core, or some other type of processor, depending on the particular implementation. A number, as used herein with reference to an item, means one or more items. Further, processor unit 904 may be implemented using a number of heterogeneous processor systems in which a main processor is present with secondary processors on a single chip. As another illustrative example, processor unit 904 may be a symmetric multi-processor system containing multiple processors of the same type.

Memory 906 and persistent storage 908 are examples of storage devices 916. A storage device is any piece of hardware that is capable of storing information, such as, for example, without limitation, data, program code in functional form, and/or other suitable information either on a temporary basis and/or a permanent basis. Storage devices 916 may also be referred to as computer readable storage devices in these examples. Memory 906, in these examples, may be, for example, a random access memory or any other suitable volatile or non-volatile storage device. Persistent storage 908 may take various forms, depending on the particular implementation.

For example, persistent storage 908 may contain one or more components or devices. For example, persistent storage 908 may be a hard drive, a flash memory, a rewritable optical disk, a rewritable magnetic tape, or some combination of the above. The media used by persistent storage 908 also may be removable. For example, a removable hard drive may be used for persistent storage 908.

Communications unit 910, in these examples, provides for communications with other data processing systems or devices. In these examples, communications unit 910 is a network interface card. Communications unit 910 may provide communications through the use of either or both physical and wireless communications links.

Input/output (I/O) unit 912 allows for input and output of data with other devices that may be connected to data processing system 900. For example, input/output (I/O) unit 912 may provide a connection for user input through a keyboard, a mouse, and/or some other suitable input device. Further, input/output (I/O) unit 912 may send output to a printer. Display 914 provides a mechanism to display information to a user.

Instructions for the operating system, applications, and/or programs may be located in storage devices 916, which are in communication with processor unit 904 through communications fabric 902. In these illustrative examples, the instructions are in a functional form on persistent storage 908. These instructions may be loaded into memory 906 for execution by processor unit 904. The processes of the different embodiments may be performed by processor unit 904 using computer implemented instructions, which may be located in a memory, such as memory 906.

These instructions are referred to as program code, computer usable program code, or computer readable program code that may be read and executed by a processor in processor unit 904. The program code in the different embodiments may be embodied on different physical or computer readable storage media, such as memory 906 or persistent storage 908.

Computer useable program code 918 is located in a functional form on computer readable media 920 that is selectively removable and may be loaded onto or transferred to data processing system 900 for execution by processor unit 904. Computer useable program code 918 and computer readable media 920 form computer program product 922 in these examples. In one example, computer readable media 920 may be computer readable storage media 924 or computer readable signal media 926. Computer readable storage media 924 may include, for example, an optical or magnetic disk that is inserted or placed into a drive or other device that is part of persistent storage 908 for transfer onto a storage device, such as a hard drive, that is part of persistent storage 908. Computer readable storage media 924 also may take the form of a persistent storage, such as a hard drive, a thumb drive, or a flash memory, that is connected to data processing system 900. In some instances, computer readable storage media 924 may not be removable from data processing system 900.

Alternatively, computer useable program code 918 may be transferred to data processing system 900 using computer readable signal media 926. Computer readable signal media 926 may be, for example, a propagated data signal containing computer useable program code 918. For example, computer readable signal media 926 may be an electromagnetic signal, an optical signal, and/or any other suitable type of signal. These signals may be transmitted over communications links, such as wireless communications links, optical fiber cable, coaxial cable, a wire, and/or any other suitable type of communications link. In other words, the communications link and/or the connection may be physical or wireless in the illustrative examples.

In some illustrative embodiments, computer useable program code 918 may be downloaded over a network to persistent storage 908 from another device or data processing system through computer readable signal media 926 for use within data processing system 900. For instance, program code stored in a computer readable storage medium in a server data processing system may be downloaded over a network from the server to data processing system 900. The data processing system providing computer useable program code 918 may be a server computer, a client computer, or some other device capable of storing and transmitting computer useable program code 918.

The different components illustrated for data processing system 900 are not meant to provide architectural limitations to the manner in which different embodiments may be implemented. The different illustrative embodiments may be implemented in a data processing system including components in addition to or in place of those illustrated for data processing system 900. Other components shown in FIG. 9 can be varied from the illustrative examples shown. The different embodiments may be implemented using any hardware device or system capable of running program code. As one example, the data processing system may include organic components integrated with inorganic components and/or may be comprised entirely of organic components excluding a human being. For example, a storage device may be comprised of an organic semiconductor.

In another illustrative example, processor unit 904 may take the form of a hardware unit that has circuits that are manufactured or configured for a particular use. This type of hardware may perform operations without needing program code to be loaded into a memory from a storage device to be configured to perform the operations.

For example, when processor unit 904 takes the form of a hardware unit, processor unit 904 may be a circuit system, an application specific integrated circuit (ASIC), a programmable logic device, or some other suitable type of hardware configured to perform a number of operations. With a programmable logic device, the device is configured to perform the number of operations. The device may be reconfigured at a later time or may be permanently configured to perform the number of operations. Examples of programmable logic devices include, for example, a programmable logic array, programmable array logic, a field programmable logic array, a field programmable gate array, and other suitable hardware devices. With this type of implementation, computer useable program code 918 may be omitted because the processes for the different embodiments are implemented in a hardware unit.

In still another illustrative example, processor unit 904 may be implemented using a combination of processors found in computers and hardware units. Processor unit 904 may have a number of hardware units and a number of processors that are configured to run computer useable program code 918. With this depicted example, some of the processes may be implemented in the number of hardware units, while other processes may be implemented in the number of processors.

As another example, a storage device in data processing system 900 is any hardware apparatus that may store data. Memory 906, persistent storage 908, and computer readable media 920 are examples of storage devices in a tangible form.

In another example, a bus system may be used to implement communications fabric 902 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 906, or a cache, such as found in an interface and memory controller hub that may be present in communications fabric 902.

Data processing system 900 may also include an associative memory. The associative memory may be in communication with communications fabric 902. The Associative memory may also be in communication with, or in some illustrative embodiments, be considered part of storage devices 916. Additional associative memories may be present.

As used herein, the term "associative memory" refers to a plurality of data and a plurality of associations among the plurality of data. The plurality of data and the plurality of associations may be stored in a non-transitory computer readable storage medium. The plurality of data may be collected into associated groups. The associative memory may be configured to be queried based on at least indirect relationships among the plurality of data in addition to direct correlations among the plurality of data. Thus, an associative memory may be configured to be queried based solely on direct relationships, based solely on at least indirect relationships, as well as based on combinations of direct and at least indirect relationships. An associative memory may be a content addressable memory.

Thus, an associative memory may be characterized as a plurality of data and a plurality of associations among the plurality of data. The plurality of data may be collected into associated groups. Further, the associative memory may be configured to be queried based on at least one relationship, selected from a group that includes direct and at least indirect relationships, or from among the plurality of data in addition to direct correlations among the plurality of data. An associative memory may also take the form of software. Thus, an associative memory also may be considered a process by which information is collected into associated groups in the interest of gaining new insight based on relationships rather than direct correlation. An associative memory may also take the form of hardware, such as specialized processors or a field programmable gate array.

As used herein, the term "entity" refers to an object that has a distinct, separate existence, though such existence need not be a material existence. Thus, abstractions and legal constructs may be regarded as entities. As used herein, an entity need not be animate. Associative memories work with entities.

The different illustrative embodiments can take the form of an entirely hardware embodiment, an entirely software embodiment, or an embodiment containing both hardware and software elements. Some embodiments are implemented in software, which includes but is not limited to forms such as, for example, firmware, resident software, and microcode.

Furthermore, the different embodiments can take the form of a computer program product accessible from a computer usable or computer readable medium providing program code for use by or in connection with a computer or any device or system that executes instructions. For the purposes of this disclosure, a computer usable or computer readable medium can generally be any tangible apparatus that can contain, store, communicate, propagate, or transport the program for use by or in connection with the instruction execution system, apparatus, or device.

The computer usable or computer readable medium can be, for example, without limitation an electronic, magnetic, optical, electromagnetic, infrared, or semiconductor system, or a propagation medium. Non-limiting examples of a computer readable medium include a semiconductor or solid state memory, magnetic tape, a removable computer diskette, a random access memory (RAM), a read-only memory (ROM), a rigid magnetic disk, and an optical disk. Optical disks may include compact disk-read only memory (CD-ROM), compact disk-read/write (CD-R/W), and DVD.

Further, a computer usable or computer readable medium may contain or store a computer readable or computer usable program code such that when the computer readable or computer usable program code is executed on a computer, the execution of this computer readable or computer usable program code causes the computer to transmit another computer readable or computer usable program code over a communications link. This communications link may use a medium that is, for example without limitation, physical or wireless.

A data processing system suitable for storing and/or executing computer readable or computer usable program code will include one or more processors coupled directly or indirectly to memory elements through a communications fabric, such as a system bus. The memory elements may include local memory employed during actual execution of the program code, bulk storage, and cache memories which provide temporary storage of at least some computer readable or computer usable program code to reduce the number of times code may be retrieved from bulk storage during execution of the code.

Input/output or I/O devices can be coupled to the system either directly or through intervening I/O controllers. These devices may include, for example, without limitation, keyboards, touch screen displays, and pointing devices. Different communications adapters may also be coupled to the system to enable the data processing system to become coupled to other data processing systems or remote printers or storage devices through intervening private or public networks. Non-limiting examples of modems and network adapters are just a few of the currently available types of communications adapters.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An antenna comprising:

a plurality of loop antennas sharing a common gap, wherein the gap is between a first end and a second end of each loop antenna of the plurality of loop antennas; and a nonlinear mixing component positioned within the gap and directly connected to both the first end and the second end of each loop antenna of the plurality of loop antennas, wherein the nonlinear mixing component is configured to collect energy from at least one of the plurality of loop antennas.

2. The antenna of claim 1, wherein the nonlinear mixing component comprises a diode.

3. The antenna of claim 1, wherein the nonlinear mixing component is selected from the group consisting of carbon nanotubes, graphene, and a doped material.

4. The antenna of claim 1, wherein exactly one of the plurality of loop antennas is configured to radiate at a mixed product frequency of input frequencies provided via other ones of the plurality of loop antennas.

5. The antenna of claim 1, wherein the plurality of loop antennas all comprise reactive near field (H-field) antennas.

6. The antenna of claim 1, wherein all of the plurality of loop antennas are connected to a common substrate.

7. The antenna of claim 6, wherein the common substrate is hand flexible.

8. An antenna comprising:

a substrate;

a first loop antenna attached to the substrate, the first loop antenna having a first perimeter;

a second loop antenna attached to the substrate, the second loop antenna having a second perimeter, the second perimeter connected to the first perimeter, the second loop antenna substantially inside the first loop antenna;

a third loop antenna attached to the substrate, the third loop antenna having a third perimeter, the third perimeter connected to the first perimeter at about a junction where the first perimeter is connected to the second perimeter, the third loop antenna substantially outside the first loop antenna; and a mixing component attached to the substrate at the junction and positioned within a gap between a first end and a second end of the first loop antenna, a first end and a second end of the second loop antenna, and a first end and a second end of the third loop antenna, wherein the mixing component is directly connected to the first end and the second end of the first loop antenna, the first end and the second end of the second loop antenna, and the first end and the second end of the third loop antenna.

9. The antenna of claim 8, wherein the mixing component comprises a nonlinear mixing component.

10. The antenna of claim 9, wherein the mixing component comprises a diode.

11. The antenna of claim 8, wherein the mixing component is selected from the group consisting of carbon nanotubes, graphene, and a doped material.

12. The antenna of claim 8, wherein the first loop antenna, the second loop antenna, the third loop antenna, and the mixing component together form a reactive near field (H-field)antenna.

13. The antenna of claim 8, wherein the first loop antenna is configured to resonate at a mixed product frequency of the second loop antenna and the third loop antenna.

14. The antenna of claim 13, wherein the mixing component mixes a first frequency of the second loop antenna and a second frequency of the third loop antenna.

15. The antenna of claim 14, wherein the mixing component comprises a radio frequency exciter for the first loop antenna.

16. The antenna of claim 8, wherein the second loop antenna and the third loop antenna use W-band frequencies and the first loop antenna has a resonant dimension of an X-band frequency.

17. The antenna of claim 8, wherein the second loop antenna is smaller than the third loop antenna, and wherein the first loop antenna is larger than both the second loop antenna and the third loop antenna.

18. The antenna of claim 8, wherein each of the first loop antenna, the second loop antenna, and the third loop antenna have corresponding shapes that are either the same as or different than other ones of the corresponding shapes, and wherein the corresponding shapes are selected from the group consisting of circles, ellipsoids, rectangles, and linear dipoles.

19. A detection system comprising:

a plurality of objects, each of the plurality of objects comprising a corresponding antenna, and wherein each corresponding antenna comprises:

a corresponding plurality of loop antennas sharing a corresponding common gap, wherein the corresponding common gap is between a first end and a second end of each loop antenna of the corresponding plurality of loop antennas; and a corresponding nonlinear mixing component positioned within the common corresponding gap and directly connected to both the first end and the second end of each loop antenna of the corresponding plurality of loop antennas, wherein the corresponding nonlinear mixing component is configured to collect energy from at least one of the corresponding plurality of loop antennas;

a transmitter transmitting a signal, wherein when the signal is received at a particular set of the corresponding plurality of loop antennas, a unique mixed product signal is generated based on a specific design of the particular set of the corresponding plurality of loop antennas;

a receiver configured to receive the unique mixed product signal;

a computer configured to identify the unique mixed product signal as belonging to a specific one of the plurality of objects; and an alert system connected to the computer and configured to alert a user when the unique mixed product signal has been received.

20. The detection system of claim 19, wherein each of the corresponding plurality of loop antennas comprise:

a corresponding substrate;

a corresponding first loop antenna attached to the corresponding substrate, the corresponding first loop antenna having a first perimeter;

a corresponding second loop antenna attached to the substrate, the corresponding second loop antenna having a second perimeter, the corresponding second perimeter connected to the first perimeter, the corresponding second loop antenna being substantially inside the corresponding first loop antenna;

a corresponding third loop antenna attached to the substrate, the corresponding third loop antenna having a third perimeter, the third perimeter connected to the first perimeter at about the common gap where the first perimeter is connected to the corresponding second perimeter, the corresponding third loop antenna being substantially outside the corresponding first loop antenna; and wherein the corresponding mixing component is attached to the substrate, at the common gap.

* * * * *